US005806692A

United States Patent [19]

Pepper

[11] Patent Number: 5,806,692

[45] Date of Patent: Sep. 15, 1998

[54] APPARATUS FOR STORAGE AND DISPLAY OF PERSONAL COMMUNICATION DEVICES

[75] Inventor: John R. Pepper, Germantown, Tenn.

[73] Assignee: The Taper Corporation, Germantown, Tenn.

[21] Appl. No.: 629,675

[22] Filed: Apr. 9, 1996

Related U.S. Application Data

[60] Provisional application No. 60/007,461 Nov. 22, 1995.

[51] Int. Cl.[6] ..... A47F 5/08

[52] U.S. Cl. ..... 211/88.01; 211/70.1; 211/126.16; 248/311.2; 248/231.9

[58] Field of Search ..... 211/87, 126, 70.1, 211/88; 248/316.5, 316.6, 300, 689, 690, 311.2, 231.9, 231.91

[56] References Cited

U.S. PATENT DOCUMENTS

| | | | |
|---|---|---|---|
| D. 257,993 | 1/1981 | De Mars | 211/88 X |
| 1,069,711 | 8/1913 | Macdonald | 211/88 X |
| 1,552,510 | 9/1925 | Scofield | 211/88 |
| 1,608,266 | 11/1926 | Forbes | 211/88 |
| 2,672,988 | 3/1954 | Johnson | 211/88 |
| 3,001,678 | 9/1961 | Maxwell | 211/72 X |
| 3,113,996 | 12/1963 | Sanford | 211/88 X |
| 3,915,308 | 10/1975 | Ratzloff et al. | 211/88 |
| 4,023,763 | 5/1977 | Pulley | 248/316.5 X |
| 4,099,813 | 7/1978 | Olivan | 211/88 X |
| 4,453,785 | 6/1984 | Smith | 312/10 |
| 4,710,596 | 12/1987 | Kurokawa | 379/424 |
| 4,984,693 | 1/1991 | Belokin, Jr. et al. | 211/88 |
| 5,040,687 | 8/1991 | Whittington | 211/40 |
| 5,050,734 | 9/1991 | Chen | 206/444 |
| 5,054,672 | 10/1991 | Weissman | 211/89 X |
| 5,120,012 | 6/1992 | Rosenau | 211/89 X |
| 5,145,655 | 9/1992 | Darlak | 422/300 |
| 5,314,103 | 5/1994 | Li | 248/231.9 |
| 5,335,795 | 8/1994 | Chizen | 211/41 |
| 5,356,060 | 10/1994 | Kuroda | 224/252 |
| 5,388,689 | 2/1995 | Kroop et al. | 206/214 |
| 5,411,145 | 5/1995 | Parks | 211/50 |
| 5,560,482 | 10/1996 | Katagiri et al. | 206/387.1 |
| 5,624,095 | 4/1997 | Zissu | 248/300 |

*Primary Examiner*—Ramon O. Ramirez
*Assistant Examiner*—Gwendolyn W. Baxter
*Attorney, Agent, or Firm*—Pravel, Hewitt, Kimball & Krieger

[57] ABSTRACT

A device that holds a personal communication device in an manner such that it can have the alpha numeric display easily read by positioning the display in the line of site of pager attendant. An angular planar surface allows the pager to be clipped on so the pager will not fall if bumped, and will hold stationary while the attendant actuates the function buttons on the pager, which can be quickly done with only one hand. The plurality of rigid surfaces will easily hold a personal communication device in other positions, but also provides a dedicated easy-to-find location of a plurality of personal communication device.

9 Claims, 3 Drawing Sheets

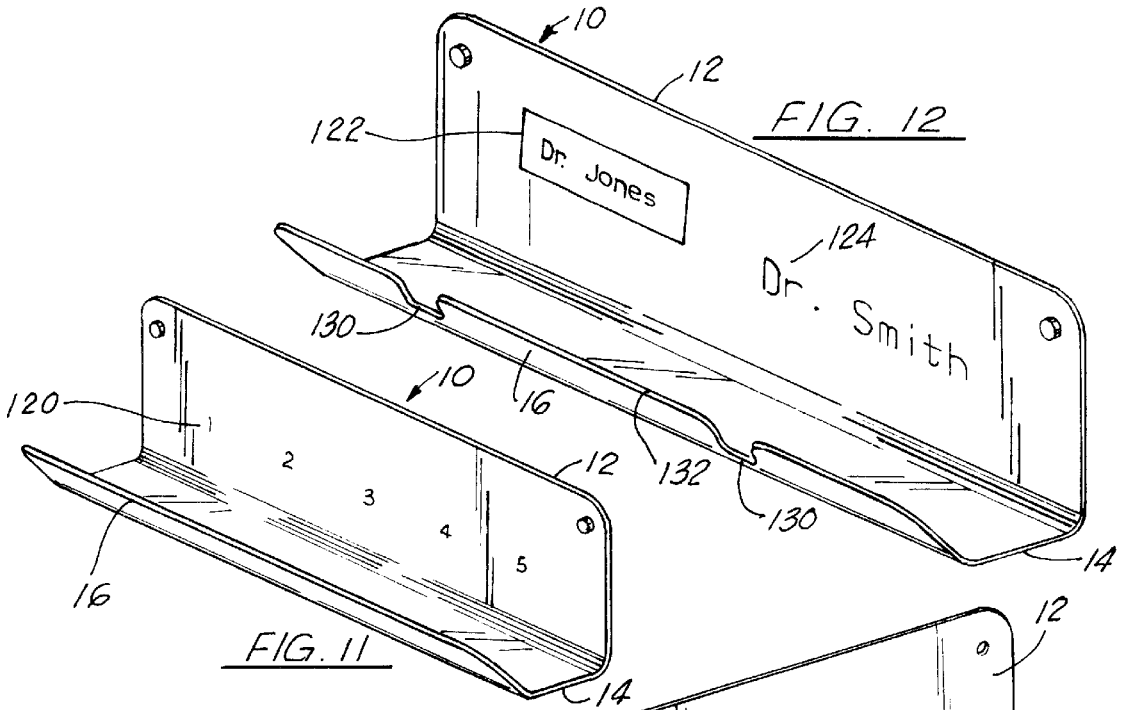
FIG. 12
FIG. 11
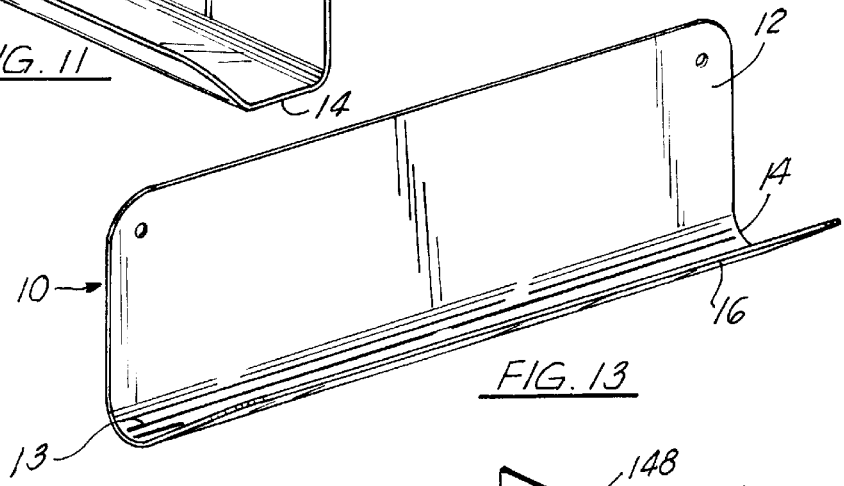
FIG. 13
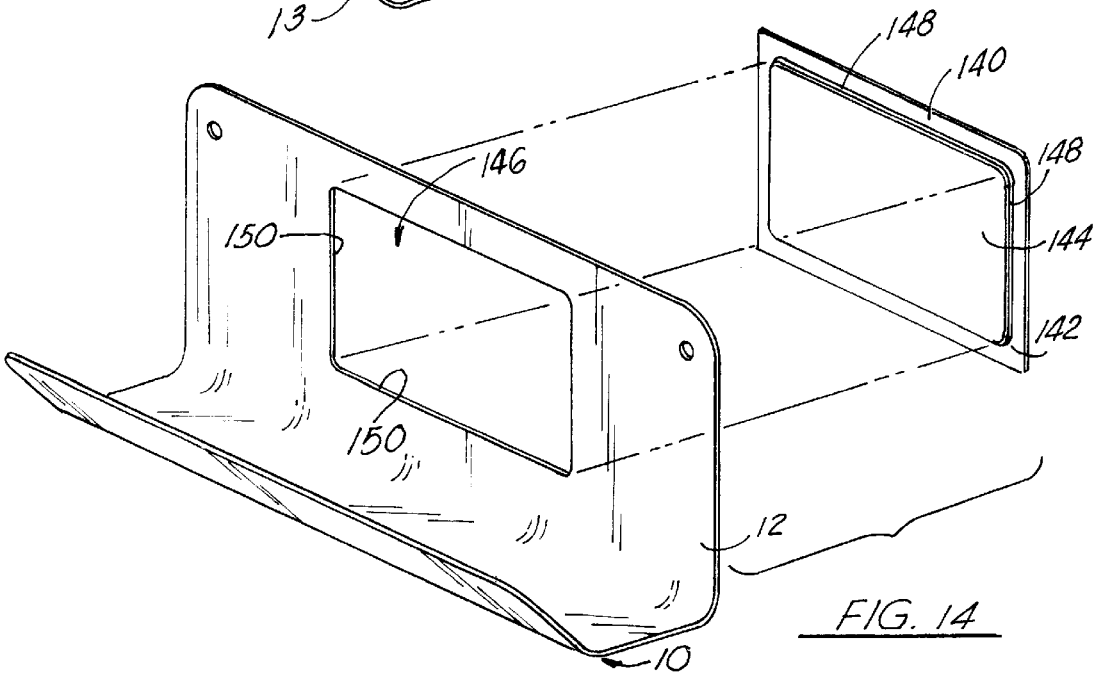
FIG. 14

APPARATUS FOR STORAGE AND DISPLAY OF PERSONAL COMMUNICATION DEVICES

SPECIFICATION

This application claims the benefit of the earlier filing date of provisional application Ser. No. 60/007,461, filed Nov. 22, 1995.

BACKGROUND OF THE INVENTION

The present invention relates to means for the positioning of personal communication devices in a business environment when conventional wearing or carrying of the device is inconvenient. My invention allows the display to be easily viewed and accessed and information quickly transferred. Particular of the embodiments described herein are utilized by health care providers in such as surgical suites and examining rooms.

DESCRIPTION OF THE PRIOR ART

Typical prior art radio pagers illustrated at 40 in FIG. 1 and at 50 in FIG. 2 are equipped with a clip for attachment to a belt or trouser waistband, and are further illustrated in U.S. Pat. Nos. 5,356,060 to Kurado and 4,802,241 to Vickers. The pagers are typically rectangular in cross section. Display of alphanumeric characters is typically on one of the smaller ends of the pager housing 42 though other surfaces may contain the display as is illustrated in FIG. 2 wherein pager 50 has its alphanumeric display 52 disposed on a lateral surface. Prior art pagers also include operating controls as illustrated at 48, 54 and 56. A mechanism for vibratory alarm and/or a visible alarm by a light emitting diode or similar light source are common features of pagers. A clip 44 for securing a pager on the person (belt or trouser) may be a rigid rectangular member with a rigid mechanical member projecting from the distal end forming an angle of approximately ninety degrees. The proximal end of the clip assembly is attached by a hinge to the body of the pager. A spring located at a fulcrum point 46 provides force to rotate the distal end of the clip assembly to directly oppose and contact a distal point on pager. The spring force holds the clip closed holding the pager in place on the belt.

A desirable design feature of the prior art pager attachment method is the ability of the pager to be clipped to the belt in a manner that allows the user to read the pager with minimal difficulty, operating the unit with one hand. As the pager is clipped to the belt, there is rarely a search for the location of the pager, as it is habitual to clip it in a similar spot on the wearer's clothing. There is not the search that frequently occurs when one searches for a ringing and misplaced cordless telephone, when the phone or may have been set down somewhere and forgotten.

The accessibility of the typical pager is one of its greatest assets, as the user instinctively looks down and reaches for it when it beeps, and is able to observe the displayed message with little inconvenience involved.

A special instance for use of these pagers use exists in hospitals. Virtually all physicians and surgeons use pagers to facilitate communication throughout the hospital and office. A patient from a previous procedure may require attention from the physician or surgeon while in another examining or operating room. Medical personnel may receive many pages and the nature of the pages is frequently life affecting, necessitating prompt response.

During examination or surgery the physician or surgeon and others attending cannot keep the pagers on their person due to operating room protocol requiring the maintenance of a sterile field. The aseptic technique requires surgeon and staff to extensively scrub their hands and arms, wear at least one pair of gloves and a gown to protect the patient from possible infection. The surgeon must remain hands-off any non-sterile equipment or risk contamination requires re-scrubbing, thereby interrupting the case.

As the typical belt carried pager can not be read from under the sterile surgical gown without contamination of the sterile environment, the pager is frequently left in an "accessible" location were it may be read by a staff member. Typically the pager is left on existing fixtures, furniture, Mayo stands (typically having a top surface of about one foot, square for surgical instrument storage), bandage shelves, on top of a wall mounted telephones, attached to the tray of a wall mounted white board, or clipped to an anesthesia cart and many other places. There are several disadvantages to these current practices, not the least of which is accidental misplacement of the device. Since there is no assigned place for the physician's or surgeon's pager, when it signals an incoming message, staff must search the room to find the beeping pager, which may be difficult and disruptive in the generally crowded examining or operating room.

The operating rooms are crowded, and it is usually not possible or convenient to make space for an additional Mayo stand or similar repository dedicated to pager storage. Additionally, maneuvering around an extra Mayo stand in the operating room would likely make the room even more cluttered and nonfunctional. Alternatives include pagers left on top of wall mounted telephones, such as is illustrated in U.S. Pat. Nos. 4,515,998 to Pindale and 4,710,596 to Kurokawa. Such approaches are not stable as there are no provisions for cradling or securing the pager, whereby the pager may fall and break. The top of the phone storage makes pager retrieval difficult and obstructed.

White board type eraser trays provide a place to clip the pager, but as the erase tray edge is generally horizontal, the pager display is not in the user's line of sight and must be removed from the stand to be read. Likewise, white boards are not always conveniently located near a telephone, requiring time to travel to and from the telephone. Anesthesia carts might be utilized to provide a place to store the pager, but the orientation angle, proximity to the phone, and open space on the cart surface are not always standard from operating room to operating room and the pager may not easily be retained in a properly oriented position for easy reading of the information screen.

It is common that several physicians, surgeons and health care staff may have pagers in one of these hospital locations compounding the problem. Especially, if all pagers are on a Mayo stand or similar table, the identification of which of the several pagers sounding an alert may be difficult. When a pager's display is facing away from a staff member, the pager will have to be picked up or otherwise moved for verification that it is signaling, then checked for its identifying features. In the alternative, the inability to readily identify the signaling pager may interrupt the medical procedure in process to identify the owner of the device. Any reduction of operating room time means savings in time and costs, and perhaps more important, a reduction of distractions to the surgical team, which is especially important during complex or involved procedures.

Secondly, the reading of the pager, if not in the users line of site, will require it to be picked up, turned to a proper orientation and actuation of the display buttons, which may require two hands, delaying the operating or operating room routine. While not a lot of time may be required, every second may be important in a extenuated situation. Conversely a pager may be inadvertently left clipped to the otherwise occupied physician's or surgeon's waist band of the scrub suit under the surgical gown, from which it would then have to be retrieved by another staff member who would have to reach up under the gown, potentially causing an embarrassing and uncomfortable situation.

Illustrations of prior equipment exist relating to temporarily storing informational containers that have been designed for ease of reading displayed information, and to secure the stored item in a logical and safe storage manner. None are readily adaptable to address the current conditions. U.S. Pat. No. 5,050,734 to Shun-Teng illustrates a storage box that orients and holds in a fixed manner, compact disks, which typically have printed information on a end panel. The ribs of the storage box that support the compact disk are oriented in the same plane as the disk case to be read. A similar vertical storage of a personal pager would not provide the optimal reading angle or storage method.

A modular cabinet illustrated in U.S. Pat. No. 4,453,785 to Smith, which has the capability to hold a plurality of cartridges with slots allowing the cartridge to be read. The angle and orientation of the cartridges would not be suitable for use with pagers. The disclosed features for storage of multiple cartridges don't lend themselves to be readily incorporated into a solution for the surgeons dilemma.

The plural-component, one-piece shipping and retail display carton illustrated in U.S. Pat. No. 5,413,276 to Sheffer discloses means that can be formed from one piece of material, having provisions for positioning of a plurality of objects for storage and viewing, and provides easy access to said stored objects. The device would be unacceptable for the present pager device use because it is made to be foldable, which would likely require a flexible material, for example, a corrugated cardboard, and would not be durable enough for repeated use in the manner required in an operating room. There is also absence of any capability to position the pager for ready viewing with this display carton.

U.S. Pat. No. 5,335,795 to Chizen illustrates a storage rack for recorded cassettes and compact discs with provision for storage and angular display of the contained objects. The rack permits some movement of the retained cassettes or discs. The pins used to hold the cassettes and discs would be unable to hold the myriad of differently shaped pager designs. The present invention will accommodate the various pager designs available today such that all fit into my universal holding apparatus.

U.S. Pat. No. 5,040,687 to Whittington illustrates means to mount a display to a wall and support a device (compact disk) in a manner that allows the easy reading of printed information. The display allows a person to easily to open the storage case and access more information, the contents of the case. The display does not allow for display at an angle, as would be the optimal viewing angle for conventional personal pager devices. The display is also not properly oriented for access to the function buttons normally found on a pager. Nor does this storage system have provisions to securely hold a pager during operation such as sequencing the operating buttons during receipt of a page.

Easy access to communication and information exchange devices are illustrated by many other patents. Features of these illustrated devices have merit, the belt holder for portable radio apparatus in U.S. Pat. No. 4,485,946 to Liautand keeps the communication device in one place, allows easy access to said device. The device would not be suitable for use with pagers, because of the inaccessibility due to the surgical gown.

The radio control transmitter holder in U.S. Pat. No. 5,155,861 to Priser discloses a radio transmitter in the line of site of the operator, and in a convenient position for the mobile operator. This device is inappropriate for use with pagers as it, too, would interfere with the surgical gown.

Similar concepts are disclosed in other illustrated devices, such as the surgical instrument rack and facilitator of U.S. Pat. No. 5,145,655. This device provides an angled surface to hold a ring handled surgical instrument. The device elevates one end of the instrument to allow easy pick-up of the instrument. It is designed to stand on a table and is not adapted for positioning on a wall. The top surface is corrugated for interfacing with the instruments, which would not support a personal pager or mobile telephone in the appropriate manner.

An open section sheet material formed to configure a rack illustrated in U.S. Pat. No. 5,411,145 to Parks. It is capable of use to hold articles that are angled for viewing such as file folders and other documents. The rack is otherwise unsuitable for use as a wall-mounted repository for communications devices as is the present invention.

In much the same manner as the pagers are regularly carried by a wearer at all waking hours, other communication devices are becoming more commonplace as "must have" items. The portable or mobile telephone is such an item. Mobile telephones are becoming a normal part of many persons lives, especially professionals (physicians, engineers, lawyers) and sales and service oriented business people. Such small, transportable or flip telephones may soon be replaced by wrist phones and videophones as the communication explosion continues. The storage of and access to these devices will pose the same challenges in the operating room as pagers presently do.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein:

FIG. 11 is a perspective view of the invention with a numeric identification label.

FIG. 12 is a perspective view of the invention adapted with an alternative label means.

FIG. 13 is a perspective view of an alternative embodiment of the invention.

FIG. 14 is a perspective view of an alternative embodiment of the invention adapted with selectively removable labeling means.

SUMMARY OF THE INVENTION

Figure 1:
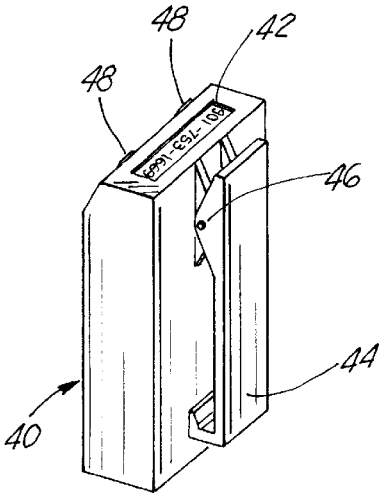
FIG. 1 PRIOR ART
FIG. 1 is a perspective view of a personal pager according to the prior art.

The present invention provides a rack for personal communication devices such as a personal pager or mobile telephone that allows the display of such device to be read, without removing the personal communication device from a storage rack. The invention provides a central and definite location for all personal communication devices to be stored in an organized and stable manner while additionally having means for identification of individual pagers.

The storage device of the present invention is preferably formed by three primary angled rigid surfaces, a horizontal stiff surface and a vertical mounting surface and an angled attaching surface, when combined provide placement of a personal communication device such that it may be stored and have the display viewed simultaneously.

A stiff planar horizontal surface may be joined to a planar vertical surface forming an angle of approximately ninety degrees. A stiff planar surface attached at an angle to the horizontal plane is preferably joined to the edge of the horizontal surface forming an angle in the approximate range of from 25 to 70 degrees to the horizontal, or an obtuse angle of 105 to 160 degrees to the pager holding surface. The vertical rear surface has means such as a plurality of holes used for mounting the device to a mounting surface with screws or similar mechanism, if desired. Alternative means of fastening the storage device to such as a wall may employ mounting of dual sided adhesive tape to the rear surfaces which mates with a wall. The rack may also be mounted by placing it on a horizontal planar surface, and held with adhesive material.

It is particularly useful in a storage device of the present invention to include also information displays on the device, so that information useful to those in proximety to the device may be advise of such information. Information displayed relating to particular personal communication devices stored on the device is particularly useful. Likewise, information relating to a procedure to be performed in such as an operating suite, or the staff on duty there is also of use. Alternative embodiments of the present invention include such informational features.

These and other features, objects and advantages of the present invention include means to organize the pagers of various design in an operating room where the pagers are easily visible, easily assessable, able to be checked with one hand in many cases, safe from damage due to falls, close to the telephone, and in a location that will remain constant day in and day out are the objects the proposed apparatus will accomplish. The rack will also accommodate addition personal communication devices (portable telephones). Centralized and organized communication will reduce confusion in the operating room and raise the efficiency of the work flow.

The use of the present invention device is not limited to medical examination rooms and surgical suites, but may also be utilized in offices, construction sites and other similar settings.

Further objects and advantages of my invention will become apparent from further consideration of the drawings and the description of the preferred embodiments.

DETAILED DESCRIPTION OF THE PREFERRED EMBODIMENT

In the following description of the several preferred embodiments of my invention, the various parts of the embodiments are identified according to the list of numbers provided below:

PARTS LIST

| Part Number | Description |
|---|---|
| 10 | storage rack |
| 12 | vertical panel |
| 13 | continuous curved tray |
| 14 | holding tray |
| 16 | angular attaching surface |
| 18 | hole |
| 20 | radiused junction |
| 22 | radiused junction |
| 24 | radiused corner |
| 40 | typical radio pager |
| 42 | alphanumeric display |
| 44 | clip |
| 46 | fulcrum |
| 48 | Operating control |
| 50 | pager |
| 52 | alphanumeric display |
| 54 | operating control |
| 56 | operating control |
| 60 | retention tab |
| 62 | retention post |
| 70 | mobile telephone |
| 72 | alphanumeric display |
| 80 | wall |
| 84 | attaching screws |
| 90 | wall mounted telephone |
| 92 | line of sight for telephone |
| 94 | line of sight for pager |
| 96 | attendant |
| 100 | pager locked on attaching surface |
| 102 | pager locked on attaching surface |
| 108 | pager unlocked on attaching surface |
| 110 | pager unlocked on attaching surface |
| 120 | numeric label |
| 122 | attachable written label |
| 124 | etched label |
| 130 | slots |
| 132 | elongate edge |
| 60 | pegs |
| 62 | fences |
| 140 | information panel |
| 142 | planar panel surface |
| 144 | raised labeling surface |
| 146 | label opening |
| 148 | panel surface perimeter edge |
| 150 | opening perimeter edge |

Figure 4:
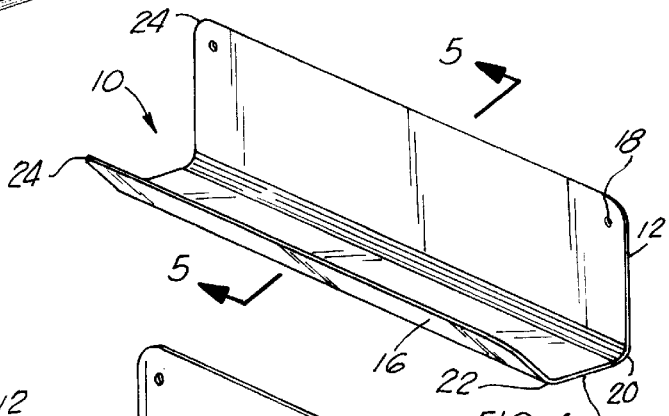
FIG. 4 is a perspective view of a preferred embodiment of the apparatus of the present invention.
Figure 5:
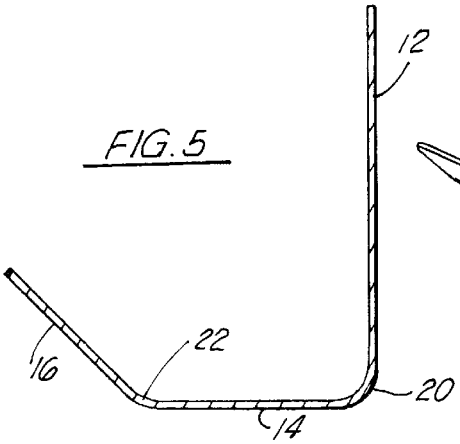
FIG. 5 is a sectional view taken along line V—V of the apparatus illustrated in FIG. 4.
Figure 7:
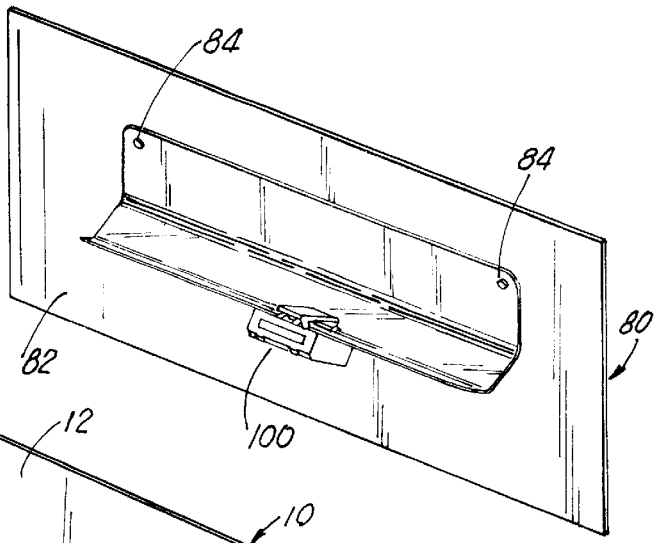
FIG. 7 is a perspective view of the apparatus illustrated in FIG. 4, attached to a support surface.

FIGS. 4 and 5 illustrate a preferred embodiment of the temporary storage apparatus of the present invention designated generally by numeral 10. Storage rack 10 includes a vertical panel 12 that is connected to a horizontal holding tray 14 which is connected to an angular attaching surface 16. The vertical panel 12 may conveniently have a height of 3 inches or longer and a width of about one foot. Dimension may be varied, being adapted to the numbers and sizes of devices needed to be stored. Hole 18 in vertical panel 12 provides means for mounting the present rack to a wall or other similar vertical surface, by means of a screw 84, bolt or similar means (as is illustrated in FIG. 7). The mounting may be supplemented or replaced by an adhesive material such as conventional double-faced tape and having dimensions less than the vertical surface 16. The holding tray 14 conveniently has a radiused junction 20 (in which the radius may be varied from approximately 0 to one-quarter inches) and has a width dimension matching the width of the vertical panel 12 and a convenient depth from approximately 1 to 5 inches.

A radiused junction 22 also may be disposed between angular attaching surface 16 and the holding tray 14 wherein the radius may be varied from approximately 0 to one-quarter inches. The attaching surface 16 conveniently has a width dimension similar to the holding tray 14, which with vertical panel 12 define the confined area of the holding tray 14 (as is illustrated in FIG. 5). The tray means preferably has a vertical depth of approximately one to 3 inches. The angular attaching surface 16 may have a radiused corners 24 (wherein the radius of is approximately 0 to one-quarter inches) to avoid personal injury such as cuts or abrasions.

Figure 6:
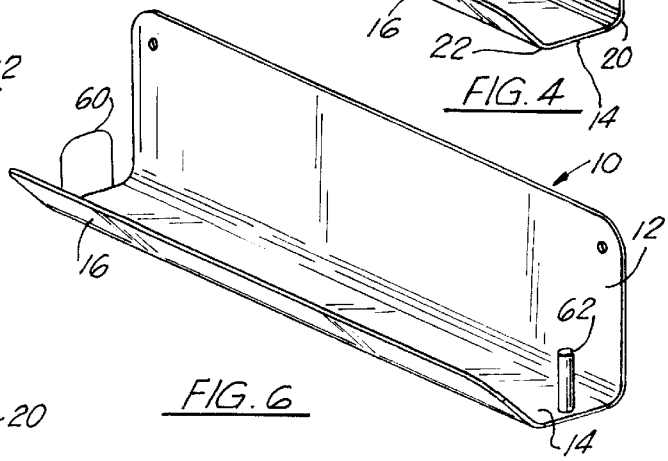
FIG. 6 is a perspective view of the apparatus illustrated in FIG. 4, including alternative means for retention of devices stored in the apparatus.

FIG. 6 illustrates alternative means of retention including retention tab 60 and retention post 62, being disposed adjacent the open ends of storage rack 10. Retention tab 60 is formed by joining a planar, upstanding tab to the storage rack 10 at approximately right angles to holding tray 14 and vertical panel 12. An alternative means of retention post 62 is illustrated as affixed to storage rack 10 at approximate right angle to holding tray 14 and vertical panel 12 at the extent of the width thereof.

The preferred embodiment of storage rack 10 may be formed from a single continuous or joined (e.g., welded) sheets of stainless steel, may be formed from a carbon steel with paint, powder coated, ceramic or other protective coating. The rack may also be formed from wood or by molding or forming a polymer or other engineered material. The material must be sufficiently stiff so that it maintains its shape when formed.

FIG. 7 illustrates storage apparatus 10 disposed on a wall 80, typically as mounted in such as a surgical suite. Storage rack or apparatus 10 may be retained on said wall 80 by means such as screws, bolts or similar fastening devices known in the art. A personal pager 100 is illustrated in attached, temporary stored position on the rack 10.

Figure 2:
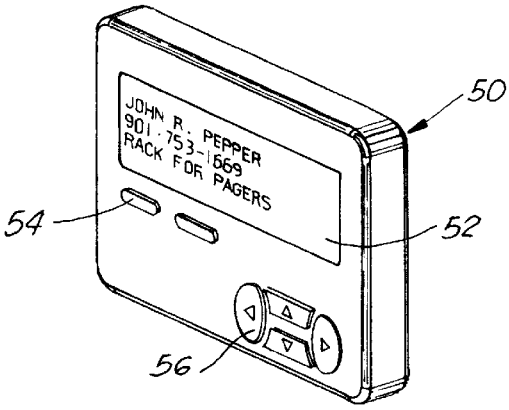
FIG. 2 PRIOR ART
FIG. 2 is a perspective view of a second personal pager according to the prior art.
Figure 3:
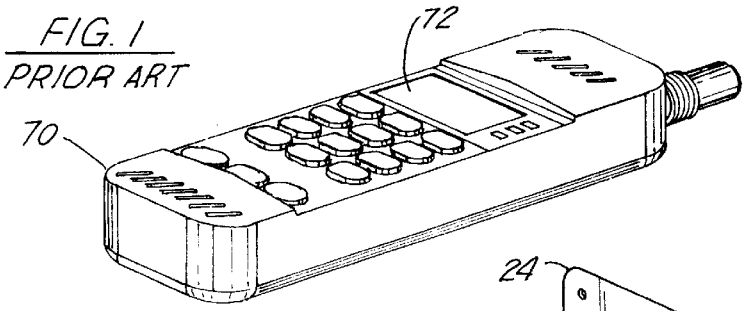
FIG. 3 PRIOR ART
FIG. 3 is a perspective view of a mobile telephone according to the prior art.
Figure 8:
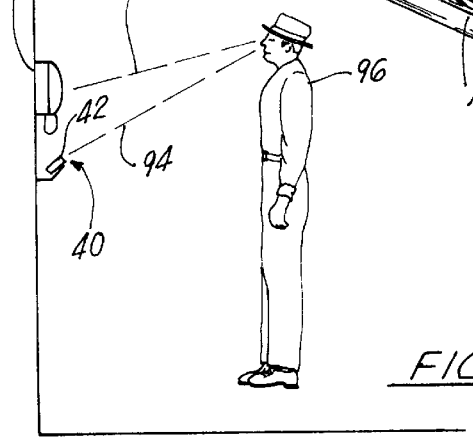
FIG. 8 is a schematic of the operation and user's line of sight illustrating use of the invention.

In utilization of the invention, a communications device such as personal pager 50 (FIG. 2) or mobile telephone 70 (FIG. 3) may be temporarily stored in the rack 10 in a variety of ways. FIG. 8 illustrates pager 40 in a position such that the alpha-numeric display 72 is positioned so that it is in line of sight 94 of an attendant 96. Likewise, the line of sight 94 for pager 40 is similar to the line of sight 92 of a conventional wall-mounted telephone 90, whose controls are generally accepted as easily accessible. A general viewing angle of approximately 30 degrees from the horizontal is convenient, though the angle may be varied to personal preference.

Figure 9:
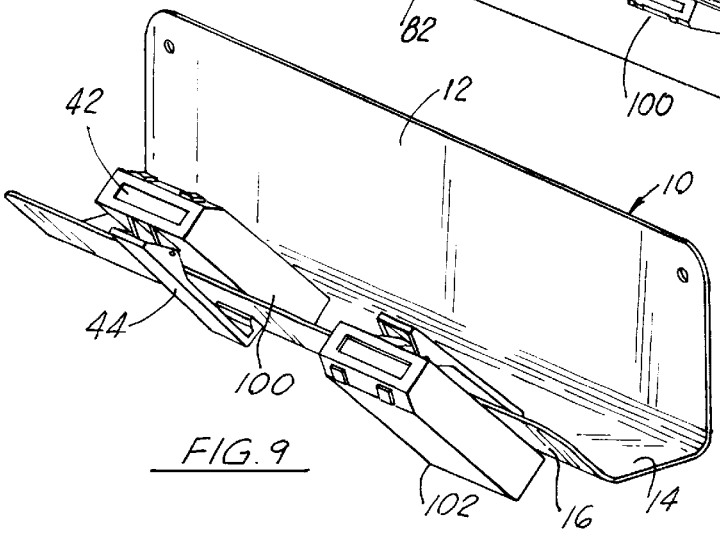
FIG. 9 is a perspective view of the invention with two personal pager devices in the locked position.
Figure 10:
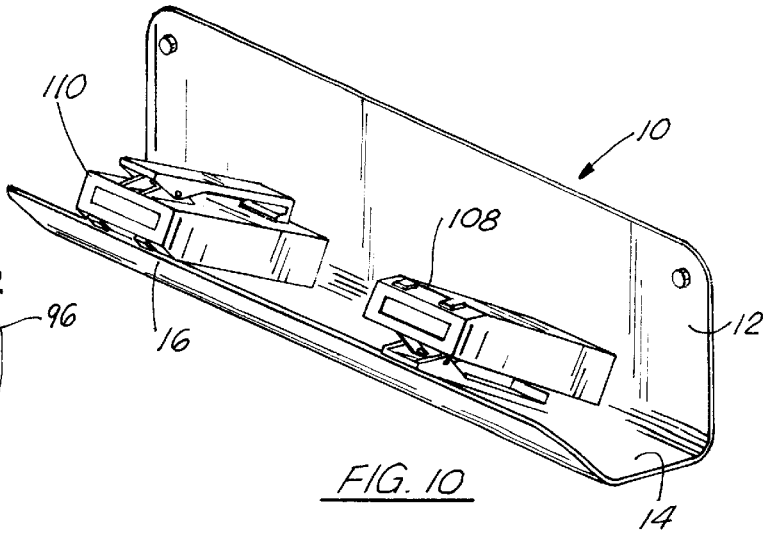
FIG. 10 is a perspective view of the invention with a pager in the angled position but not locked.

The "locked" position of pagers 100 and 102 in storage rack 10 is an alternative manner of operation and is illustrated in FIG. 9. The clip 44 of the personal communication device 102 is opened and engages the angular attaching surface 16 of the storage rack 10. The personal communication device 102 may be disposed above the angular attaching surface 16 or below it as is illustrated personal pager 100. The locked position maintains the personal communication device secured in place if other personal communication device are haphazardly tossed into the storage rack 10. In the alternative to "locked" positioning of pagers 100 and 102, FIG. 10 illustrates pagers 108 and 110 placed loosely on holding tray 14 and bearing on angular attaching surface 16 of rack 10.

FIGS. 11 and 12 illustrate alternative embodiments of identification of dedicated areas or positions on storage rack 10. The designated positions on storage rack 10 may be indicated by a chosen array of numbers or letters 120, or a combination thereof FIG. 11 illustrates numbered positions. A ceramic or other relatively non-porous coating on the substrate material forming storage rack 10 as is illustrated in FIG. 12 at 122, may provide a markable and erasable surface that can be written upon by such as a dry erase marker to identify location of a particular surgeon's pager. Alternatively, a more permanent means to label a pager position on vertical panel 12 of storage rack 10 is illustrated in FIG. 12 wherein an identification label 124 (herein "Dr. Smith") is engraved, embossed or painted on the vertical panel 12. Alternatively, printed or written labels may be detachably attached to such as vertical panel 12 by such as a double faced adhesive tape or cooperating hook and loop fastener means. Additionally illustrated in FIG. 12 are locating means such as slots 130 disposed in the exposed elongate edge 132 of angular attaching surface 16. Inclusion of such fixed locating means opposite a labeled pager position facilitates proper location of a personal pager or mobile telephone. Alternative means such as pegs 136 or fences 138 are illustrated in FIG. 13.

FIG. 13 shows an alternative embodiment of rack 10 wherein vertical panel 12 is directly attached to angular attaching surface 16 through a continuously curved tray 13. In this embodiment holding tray 14 forms a curved surface 13 which may be more suitable to storage of a variety of differently sized personal communications devices. The operation of this embodiment is otherwise similar to those described in the previous figures.

FIG. 14 illustrates a further alternative embodiment of the rack 10, wherein vertical panel 12 includes a detachable information panel 140 which, for convenience is generally rectangular in form. Disposed on one of the planar surfaces 142 of information panel 140 is a raised labeling surface 144, which again for convenience is generally rectangular in shape. In the illustrated embodiment, label opening 146 is rectangular in shape, being of a size to very closely approximate the dimensions of raised labeling surface 144. By sizing the perimeter dimensions of surface 144 and opening 146 such that there is a slight interference fit there between, information panel 140 may be retained within opening 146 in vertical panel 12 when positioned therein. As will be recognized by those skilled in the art, perimeter edges 148 of the raised label surface 144 define surfaces which may mate with perimeter edges 150 of opening 146 to define such as an interference fit so as to retain panel 144 within opening 146. Alternatively, flange or other retaining means may be disposed on either perimeter edges 148 and/or the cooperating edges of perimeter edges 150. By such means, information panels 140 may be readily removed so that labeling information may be conveniently placed thereon or removed therefrom. Likewise, alternative panels 140 may be made up in advance and readily replaced such as when a particular surgical team presents itself to a given operating room. Alternative attaching means for information panel 140 to vertical panel 12 include such as adhesive materials including "double-faced" tape (disposed on such as surface 142), clip fasteners, rivets, screw fasteners of various types and other means well known in the art.

Information panels 140 are an important feature of the present invention providing a ready reference location for providing not only information relating to the personal communication device being stored within the rack 10 but also other information germane to procedures ongoing in an examining room or surgical suite. It is considered within the scope of the invention that information panel 140 may also be a digital display, responsive to transmitted signals, perhaps similar to those communicated to personal communication devices, such that messages may be prominently displayed to staff.

Because many varying and different embodiments may be made within the scope of the inventive concept herein taught, and because many modifications may be made in the embodiments herein detailed in accordance with the descriptive requirement of the law, it is to be understood that the details herein are to interpreted as illustrative and not in a limiting sense.

I claim:

1. Storage tray apparatus for mounting on a vertical support surface in a medical facility for temporarily holding and orienting a personal communication device for ready message observation when the device user is otherwise manually engaged in the facility comprising:

a generally rectangular vertical panel adapted for fastening directly to the support surface and having disposed thereon identified discrete communication device lateral positions, said panel being oriented with opposite sides of said rectangular panel disposed generally horizontally;

a generally rectangular holding tray having a lateral width substantially equal to that of said vertical panel attached by one of its longer sides to said vertical panel along one of its said opposite, horizontally disposed longer rectangular sides so as to be substantially perpendicular to said vertical panel;

a generally rectangular communication device attaching panel having a lateral width substantially equal to that of said vertical panel and said holding tray angularly disposed on the opposite side of said rectangular holding tray opposite the side of said tray attached to said vertical panel, said attaching panel forming an obtuse angle with said tray means;

said communication device attaching panel and tray adapted to receive the personal communication device on said storage apparatus;

wherein said vertical panel is adapted with information surfaces disposed adjacent the identified lateral positions in said attaching panel whereby areas of said tray may be designated to a particular communication device temporarily stored on said tray and said information surface on said vertical panel includes a coating forming a writing surface of generally non-porous material whereby said label surface may be written over with a removable ink.

2. The apparatus according to claim 1 wherein said attaching panel is disposed at an obtuse angle with respect to said tray of about 105 to about 160 degrees.

3. The apparatus according to claim 2 wherein said attaching panel is disposed at an obtuse angle with respect to said tray of about 150 degrees.

4. The apparatus according to claim 2 wherein said attaching panel includes a recessed portion disposed in the rectangular side opposite said rectangular side attached to said tray adjacent said identified lateral positions and having a width sufficient to receive the attaching means of a personal communication device therein whereby said device may be detachably attached at a designated position on said tray.

5. The apparatus according to claim 1 wherein said tray has a curved cross section in a plane taken perpendicularly to said longer sides of said tray.

6. The apparatus according to claim 1 having retention means disposed at opposite ends of said tray, intermediate the termination of said opposite, horizontally disposed rectangular sides of said tray whereby personal communications devices placed in said tray are retained therein.

7. The apparatus according to claim 1 wherein said vertical panel, tray means and attaching panel are formed of a single sheet of material, and the juncture of adjoining, attached opposite, horizontally disposed sides of said rectangular elements is formed by bending said sheet material to form a radius at said juncture.

8. Storage tray apparatus for mounting on a vertical support surface in a medical facility for temporarily holding and orienting a personal communication device for ready message observation when the device user is otherwise manually engaged in the facility comprising:

a generally rectangular vertical panel adapted for fastening directly to the support surface and having disposed thereon identified discrete communication device lateral positions, said panel being oriented with opposite sides of said rectangular panel disposed generally horizontally;

a generally rectangular holding tray having a lateral width substantially equal to that of said vertical panel attached by one of its longer sides to said vertical panel along one of its said opposite, horizontally disposed longer rectangular sides so as to be substantially perpendicular to said vertical panel;

a generally rectangular communication device attaching panel having a lateral width substantially equal to that of said vertical panel and said holding tray angularly disposed on the opposite side of said rectangular holding tray opposite the side of said tray attached to said vertical panel, said attaching panel forming an obtuse angle with said tray means;

said communication device attaching panel and tray adapted to receive the personal communication device on said storage apparatus;

wherein said vertical support means is adapted with an information surface disposed adjacent said tray means whereby information relevant to the situs of said storage means is displayed to occupants thereof and said information surface is a selectively detachable panel, having attaching means thereon so as to be selectively placeable on the vertical panel of said apparatus.

9. The apparatus according to claim 8 wherein said information surface has mounting means thereon, for selectively attaching said information surface on the rear surface of said vertical panel, in register with an opening disposed in said vertical panel, whereby said label surface is viewable through said opening when said label surface is mounted on said vertical panel.

* * * * *